US007628530B2

(12) United States Patent
Andren et al.

(10) Patent No.: US 7,628,530 B2
(45) Date of Patent: Dec. 8, 2009

(54) WATCH CASING CONSTRUCTION INCORPORATING WATCH BAND LUGS

(75) Inventors: Bo Stefan Andren, Portland, OR (US); Stephen D. Berry, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 11/686,333

(22) Filed: Mar. 14, 2007

(65) Prior Publication Data

US 2008/0225649 A1 Sep. 18, 2008

(51) Int. Cl.
*A44C 5/00* (2006.01)
*A44C 5/14* (2006.01)

(52) U.S. Cl. ..... 368/281; 224/177

(58) Field of Classification Search ..... 368/281, 368/282; 224/164–180
See application file for complete search history.

(56) References Cited

U.S. PATENT DOCUMENTS 1,512,544 A 10/1924 Kalweit
1,905,681 A * 4/1933 Carlson ..... 24/71 J
1,905,685 A 4/1933 Carlson
4,034,552 A * 7/1977 Davidson ..... 368/280
4,390,288 A 6/1983 Arnoux
4,493,561 A 1/1985 Bouchet
4,674,892 A 6/1987 Loth
4,757,486 A 7/1988 Wollman
5,373,484 A 12/1994 Rappo et al.
5,526,006 A 6/1996 Akahane et al.
5,652,736 A * 7/1997 Lee ..... 368/278
6,449,812 B1 9/2002 Calce
6,619,835 B2 9/2003 Kita
6,712,501 B2 3/2004 Kinkio et al.

(Continued)

FOREIGN PATENT DOCUMENTS

CH 649675 6/1985

(Continued)

OTHER PUBLICATIONS

Translation of Detailed Description for document JP 2003329782; Mar. 21, 2008.*

(Continued)

*Primary Examiner*—Vit W Miska
*Assistant Examiner*—Sean Kayes
(74) *Attorney, Agent, or Firm*—Banner & Witcoff, Ltd.

(57) ABSTRACT

A watch case construction incorporating a pair of watch band lugs. The watch case may include an upper casing portion defining two opposing pairs of upper casing apertures and a lower casing portion defining two opposing pairs of lower casing apertures, with the upper casing portion being mated to the lower casing portion so that each upper casing aperture overlaps a lower casing aperture. The watch case also has a pair of opposing band lugs, with each band lug having a band portion for affixing a band thereto and a pair of attachment portions each defining a lug aperture. The attachment portions are interposed between the upper casing portion and the lower portion so that each lug aperture overlaps an upper casing aperture and a lower casing aperture. Still further, the case will include a plurality of fasteners, with a fastener extending through each of the upper casing apertures, the lug apertures, and the lower casing apertures to secure the band lug to the watch casing.

18 Claims, 3 Drawing Sheets

U.S. PATENT DOCUMENTS

| | | | | |
|---|---|---|---|---|
| 7,019,702 | B2 | | 3/2006 | Henriet et al. |
| D573,486 | S | * | 7/2008 | Sanz ..... D10/38 |

FOREIGN PATENT DOCUMENTS

| | | | |
|---|---|---|---|
| CH | 654713 | | 3/1986 |
| JP | 2003329782 | * | 11/2003 |
| WO | 94/08482 | | 4/1994 |
| WO | 00/62638 | | 10/2000 |

OTHER PUBLICATIONS

PCT/US2008/056472, International Search Report, dated Feb. 24, 2009.
PCT/US2008/056472, Written Opinion, dated Feb. 24, 2009.

* cited by examiner

WATCH CASING CONSTRUCTION INCORPORATING WATCH BAND LUGS

FIELD OF THE INVENTION

The present invention relates to a watch construction for attaching a watch band lug to a watch. Various examples of the invention may be particularly applicable to a watch band case that incorporates a watch band lug into its construction.

BACKGROUND OF THE INVENTION

The watch industry is continuously seeking to improve the durability of watch bands. Originally, watch bands were formed from leather or fabric. While these materials were relatively flexible and comfortable, bands made from these materials were not very durable. Exposure to water and continuous wear, for example, will quickly degrade leather and fabric watch bands. To address these deficiencies, some watch makers have created watch bands out of metal links. Metal link watch bands are more resilient than leather and fabric watch bands, but they are relatively heavy and expensive.

Recently, inexpensive and rugged watches have become popular, particularly for various sporting activities such as running, boating, diving, and climbing. In order to keep the cost of these watches low while still providing an environmentally-resistant band, some watch makers have begun using watch bands formed from plastic or rubber.

These bands conventionally will have an attachment portion on each end that defines some type of a springbar passage for receiving a springbar. As known in the art, a springbar has a hollow cylinder containing two pins at either end. The pins are forced outward by a spring within the cylinder. The watch, in turn, will have two extensions or "lugs" that extend from each side of the watch (i.e., the watch will have a pair of opposing lugs on either side). Usually, these lugs are integrally formed with the watch casing. Also, each lug defines a pin recess facing a corresponding pin recess on the opposite lug.

To attach the band to a watch, a springbar is inserted into the springbar passage of an attachment portion at one end of the band, and the pins are pressed into the hollow cylinder. With the pins thus compressed, the attachment portion of the band is inserted between two opposing lugs of a watch casing. When the attachment portion is positioned so that the springbar is aligned between the lug recesses, the spring in the springbar forces the pins into the lug recesses to secure the attachment portion between the lugs. This process is then repeated with the attachment portion on the other end of the watch band and the remaining pair of opposing lugs.

While this configuration allows a watch band to be quickly replaced, the entire strength of the attachment is based upon the springbar. If enough force is placed on the band or watch to bend the springbar or to compress even one of the pins in the springbar, then the band will come away from the watch. Because conventional springbars are very thin (typically not more than 1-1.5 millimeters in diameter), this type of separation is not an uncommon occurrence. Accordingly, watch makers are continuously seeking improved techniques and structures to securely attach a watch band to a watch.

BRIEF SUMMARY OF THE INVENTION

Various embodiments of the invention provide a watch case construction incorporating a pair of watch band lugs. With some implementations of the invention, for example, a watch case will include an upper casing portion defining two opposing pairs of upper casing apertures and a lower casing portion defining two opposing pairs of lower casing apertures, with the upper casing portion being mated to the lower casing portion so that each upper casing aperture overlaps a lower casing aperture. The watch case also has a pair of opposing band lugs, with each band lug having a band portion for affixing a band thereto and a pair of attachment portions each defining a lug aperture. The attachment portions are interposed between the upper casing portion and the lower portion so that each lug aperture overlaps an upper casing aperture and a lower casing aperture. Still further, the case will include a plurality of fasteners, with a fastener extending through each of the upper casing apertures, the lug apertures, and the lower casing apertures to secure the band lug to the watch casing.

DETAILED DESCRIPTION OF THE INVENTION

Double Casing Construction

Figure 1:
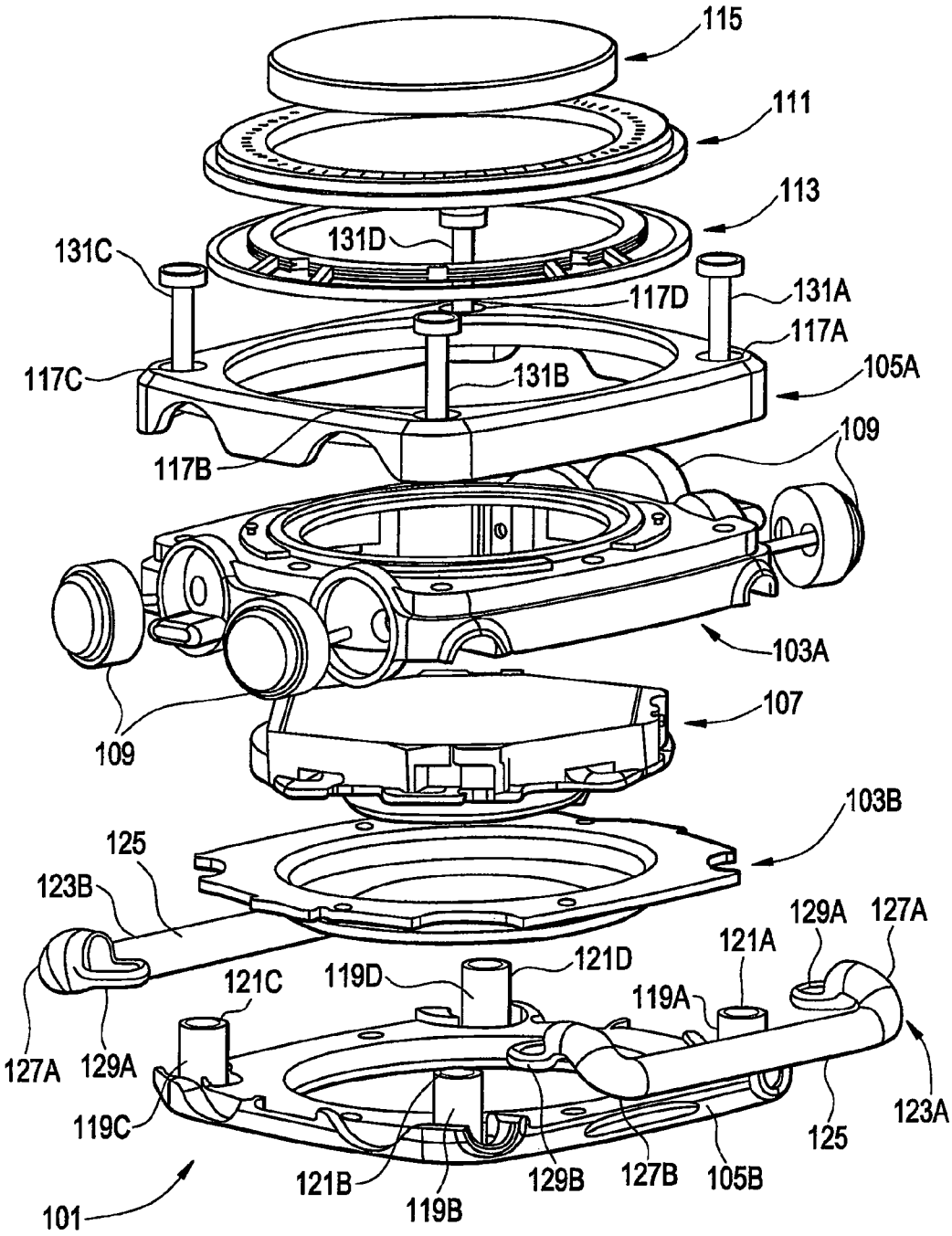
FIG. 1 is an exploded perspective view of a wristwatch implementing a watch casing construction according to various examples of the invention.

FIG. 1 is an exploded perspective view of a watch 101 implementing a watch casing construction according to various examples of the invention. More particularly, FIG. 1 illustrates a watch 101 employing an inner watch case 103 and an outer watch case 105. The inner watch case 103 includes an upper inner watch case portion 103A and a lower inner case watch portion 103B. The outer watch case 105 then includes an upper outer watch case portion 105A and a lower outer watch case portion 105B.

With various embodiments of the invention, the case portions may be formed of any desired material or combinations of materials. Typically however, the case portions will be formed of a relatively hard and durable material, such as hard plastics, hard rubbers, hard resins, metals or metal alloys, or some combination thereof to protect the more sensitive components of the watch from damage and environmental hazards. With some implementations of the invention, for example, the lower inner case watch portion 103B may be formed of stainless steel or some other metal or metal alloy, while the upper inner watch case portion 103A, the upper outer watch case portion 105A and the lower outer watch case portion 105B are formed of a polycarbonate material, such as a polycarbonate material with a 15% glass fill.

The inner watch case 103 encases a watch movement module 107. With various implementations of the invention, the watch movement module 107 may include mechanical components, electrical components, or some combination thereof. The watch movement module 107 may include, e.g.; the components to perform any desired function associated with a watch. For example, the watch movement module 107 may provide a chronometer function, a stopwatch function, a timer function, an altimeter function, a thermometer function, a barometer function, or a remote control function for another electronic device. Similarly, if the watch movement module 107 implements one or more functions (e.g., a chronometer, stopwatch, or timer function) using mechanical components, then these mechanical components may be housed within the watch movement module 107 as well.

Alternately or additionally, the watch movement module 107 may contain components to perform any other function or functions associated with a portable mechanical or electrical device. For example, with various embodiments of the invention, the watch movement module 107 can include the components to serve as a hand-held digital music player, a radio, a wireless telephone, a compass, a radio-frequency navigation device (e.g., a GPS navigation device), a calculator, a digital memory storage device, or the like. A plurality of control buttons 109 (or other type of control mechanism) is then provided to control the operation of the watch movement module 107.

The outer watch case 105 encases the inner watch case 103. As seen in FIG. 1, it also encases a lens ring 111 and a dust ring 113. The lens ring 111 holds a lens 115 over the watch movement module 107. As well known in the art, the lens 115 allows a user to view information displayed by the watch movement module 107. The watch movement module 107 may display information measured or otherwise produced by the function of its components using, for example, a liquid crystal display (LCD), a light emitting diode (LED) display, an organic light emitting (OLE) display, one or more analog rotating hands or dials, or another type of display using any other desired technology. The dust ring 113 prevents dust and other debris from reaching the watch movement module 107 through the spacing created between the lens 115 and the lens ring 111, or between the lens ring 111 and the outer watch case 105. The lens ring 111 and the dust ring 113 may be formed of any desired material. The lens ring 111, for example, may be formed of a relatively hard material, such as a hard plastic material (e.g., polycarbonate having a 15% glass fill), a hard rubber material, a hard resin, or a metal or metal alloy. The dust ring 113 may then be formed of a more flexible or compressible material, such as a soft plastic (e.g., polyurethane), a soft rubber material, or a soft resin.

As seen in FIG. 1, the upper outer watch case portion 105A includes four apertures 117A-117D. A first pair of upper outer watch case apertures 117A and 117B is positioned on a first side of the outer watch case 105, while the second pair of upper outer watch case apertures 117C and 117D is positioned on a second side of the outer watch case 105 opposite the first side. Similarly, the lower outer watch case portion 105B includes four threaded cylinders 119A-119D defining apertures 121A-121D. A first pair of lower outer watch case cylinders 119A and 119B and corresponding apertures 121A and 121B are positioned on a first side of the outer watch case 105, while the second pair of lower outer watch case cylinders 119C and 119D and corresponding apertures 121C and 121D are positioned on a second side of the outer watch case 105 opposite the first side.

The upper outer watch case apertures 117A-117D and the lower outer watch case apertures 121A-121D are arranged so that each upper outer watch case aperture 117 overlaps a corresponding lower outer watch case aperture 121. With various examples of the invention, each upper outer watch case aperture 117 and each lower outer watch case aperture 121 is approximately the same size.

The watch 101 also includes a pair of watch band lugs 123A and 123B. Each watch band lug 123 includes a band portion 125, and two attachment portions 127A and 127B at either end of the band portion 125. The band portion 125 may have, for example, a diameter of approximately 3 millimeters. With various examples of the invention, the band lugs 123 may be formed of a durable material, such as a metal, a metal alloy, a hard plastic, a hard resin, or a hard rubber. With some implementations of the invention, the band lugs 123 may be formed of a rigid material. For still other implementations of the invention, however, the band lugs 123 or the band portion 125 of the band lugs may be formed of a flexible material, such as a metal wire.

The attachment portion 127 of each lug 123 defines a lug aperture 129. With various examples of the invention, each lug aperture 129 is approximately the same size as the upper outer watch case apertures 117A-117D and the lower outer watch case apertures 121A-121D. The band portion 125 is configured so that a watch band can be wrapped around the band portion 125, molded around the band portion 125, or alternately, so that the band portion 125 can be inserted through a passage formed in an end of a watch band (similar to a springbar passage formed in many conventional watch bands). In this manner, a watch band can be securely affixed to the band portion 125 of a band lug 123.

As seen in FIG. 1, the watch band lugs 123A and 123B are positioned so that each lug aperture 129 overlaps both an upper outer watch case aperture 117 and its corresponding lower outer watch case aperture 121. More particularly, the first watch band lug 123A is positioned so that its first lug aperture 129A overlaps the upper outer watch case aperture 117A and fits over the threaded cylinder 119A so as to overlap its corresponding lower outer watch case aperture 121A, and so that its second lug aperture 129B overlaps the upper outer watch case aperture 117B and fits over the threaded cylinder 119B so as to overlap its corresponding lower outer watch case aperture 121B. The second watch band lug 123B then is positioned so that its first lug aperture 129A overlaps the upper outer watch case aperture 117C and fits over the threaded cylinder 119C so as to overlap its corresponding lower outer watch case aperture 121C, and so that its second lug aperture 129B overlaps the upper outer watch case aperture 117C and fits over the threaded cylinder 119D so as to overlap its corresponding lower outer watch case aperture 121D.

With the case construction shown in FIG. 1, the upper outer watch case portion 105A is secured to the lower outer watch case portion 105B by fasteners that extend through each upper outer watch case aperture 117, each lug aperture 129, and each lower outer watch case aperture 121 into each threaded cylinder 119. For example, with the embodiment illustrated in FIG. 1, the watch 101 includes four threaded screws 131A-131D. The first threaded screw 131A extends through the upper outer watch case aperture 117A, through the lug aperture 129A of the first band lug 123A, and through the lower outer watch case aperture 121A into the threaded cylinder 119A. Similarly, the second threaded screw 131B extends through the upper outer watch case aperture 117B, through the lug aperture 129B of the first band lug 123A, and through the lower outer watch case aperture 121B into the threaded cylinder 119B. The third threaded screw 131C then extends through the upper outer watch case aperture 117C, through the lug aperture 129A of the second band lug 123B, and through the lower outer watch case aperture 121C into the threaded cylinder 119C, while the fourth threaded screw 131D then extends through the upper outer watch case aperture 117D, through the lug aperture 129B of the second band lug 123B, and through the lower outer watch case aperture 121D into the threaded cylinder 119D.

Because the attachment portion 127 of each band lug 123 is securely sandwiched between the upper outer watch case portion 105A and the lower outer watch case portion 105B, rather than by the expansive force of a spring in a conventional springbar, a watch band attached to the band lugs 123 will be more securely attached to the watch 101 than with a conventional springbar. Further, because the band lugs 123 are incorporated directly into the case construction, the band lugs 123 can be substantially thicker, and thus stronger, than a conventional springbar.

Single Casing Construction

Figure 2:
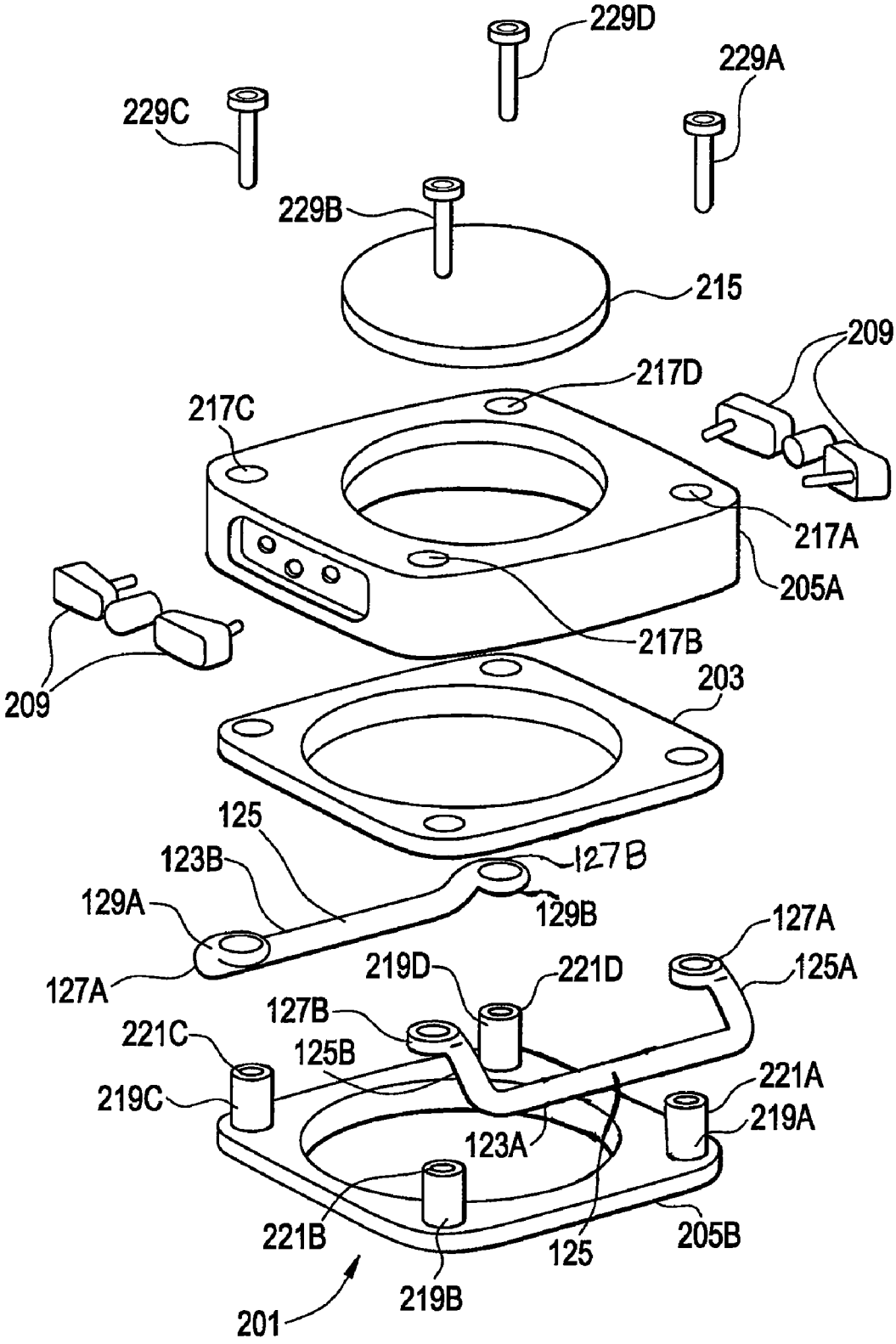
FIG. 2 is an exploded perspective view of a wristwatch implementing another watch casing construction according to various examples of the invention.

FIG. 2 shows an exploded perspective view of a watch 201 implementing another watch casing construction according to various examples of the invention. While the watch 101 illustrated in FIG. 1 includes two watch cases (an inner watch case 103 and an outer watch case 105), the watch 201 has only a single watch case 205. As seen in this figure, the watch case 205 includes an upper watch case portion 205A and a lower watch case portion 205B.

With various embodiments of the invention, the case portions may be formed of any desired material or combinations of materials. Typically however, the case portions will be formed of a relatively hard and durable material, such as hard plastics, hard rubbers, hard resins, metals or metal alloys, or some combination thereof to protect the more sensitive components of the watch from damage and environmental hazards. With some implementations of the invention, for example, the upper watch case portion 205A and the lower watch case portion 205B are formed of a polycarbonate material, such as a polycarbonate material with a 25% glass fill.

The watch case 205 encases a watch movement module (not shown) positioned in the upper watch case portion 205A. As shown in FIG. 2, various examples of the invention may optionally include a watch movement cover 203. The watch movement cover 203 may be secured to the upper watch case portion 205A to help protect the watch movement module from moisture, dust, and other debris. The watch movement cover 203 may be formed of any desired material, but will typically be formed of a relatively hard and durable material, such as a hard plastic, a hard rubber, a hard resin, metal or a metal alloy, or some combination thereof. With some implementations of the invention, for example, the watch movement cover 203 may be formed of stainless steel or another metal or metal alloy.

As with the examples of the invention illustrated in FIG. 1, the watch movement module may include mechanical components, electrical components, or some combination thereof. The watch movement module may include the components to perform any desired function associated with a watch. For example, the watch movement module may provide a chronometer function, a stopwatch function, a timer function, an altimeter function, a thermometer function, a barometer function, or a remote control function for another electronic device. Similarly, if the watch movement module implements one or more functions (e.g., a chronometer, stopwatch, or timer function) using mechanical components, then these mechanical components may be housed within the watch movement module as well.

Alternately or additionally, the watch movement module may contain components to perform any other function or functions associated with a portable mechanical or electrical device. For example, with various embodiments of the invention, the watch movement module can include the components to serve as a hand-held digital music player, a radio, a wireless telephone, a compass, a radio-frequency navigation device (e.g., a GPS navigation device), a calculator, a digital memory storage device, or the like. A plurality of control buttons 209 (or other type of control mechanism) is then provided to control the operation of the watch movement module.

In addition to the watch movement, the watch case 205 encases a lens 215 over the watch movement module. As well known in the art, the lens 215 allows a user to view information displayed by the watch movement module. The watch movement module may display information measured or otherwise produced by its functional components using, for example, a liquid crystal display (LCD), a light emitting diode (LED) display, an organic light emitting (OLE) display, one or more analog rotating hands or dials, or another type of display using any other desired technology. Of course, the watch case 205 may additionally encase any other desired watch parts, such as a lens ring or a dust ring.

As seen in FIG. 2, the upper watch case portion 205A includes four apertures 217A-217D. A first pair of upper watch case apertures 217A and 217B is positioned on a first side of the upper watch case portion 205A, while the second pair of upper watch case apertures 217C and 217D is positioned on a second side of the upper watch case portion 205A opposite the first side. Similarly, the lower watch case portion 205B includes four threaded cylinders 219A-219D defining apertures 221A-221D, respectively. A first pair of lower watch case cylinders 219A and 219B defining apertures 221A and 221B is positioned on a first side of the lower watch case portion 205B, while the second pair of lower outer watch case cylinders 219C and 219D defining apertures 221C and 221D is positioned on a second side of the lower watch case portion 205B opposite the first side. The upper watch case apertures 217A-217D and the lower watch case apertures 221A-221D are arranged so that each upper watch case aperture 217 overlaps a corresponding lower watch case aperture 221. With various examples of the invention, each upper watch case aperture 217 and each lower watch case aperture 221 is approximately the same size.

The watch 201 also includes a pair of watch band lugs 123A and 123B. As previously described, each watch band lug 123 includes a band portion 125 and two attachment portions 127A and 127B at either end of the band portion 125. Each attachment portion 127 defines a lug aperture 129. With various examples of the invention, each lug aperture 129 is approximately the same size as the upper outer watch case apertures 217 and the lower outer watch case apertures 221. The band portion 125 is configured so that a watch band can be wrapped around the band portion 125, molded around the band portion 125, or alternately, so that the band portion 125 can be positioned in a passage formed in an end of a watch band (similar to a springbar passage formed in many conventional watch bands). In this manner, a watch band can be securely affixed to the band portion 125 of a band lug 123.

As seen in FIG. 2, the watch band lugs 123A and 123B are positioned so that each lug aperture 129 overlaps both an upper watch case aperture 217 and its corresponding lower watch case aperture 221. More particularly, the first watch band lug 123A is positioned so that its first lug aperture 129A overlaps the upper watch case aperture 217A and fits over the threaded cylinder 219A so as to overlap its corresponding lower watch case aperture 221A, and so that its second lug aperture 129B overlaps the upper watch case aperture 217B and fits over the threaded cylinder 219B so as to overlap its corresponding lower watch case aperture 221B. The second watch band lug 123B then is positioned so that its first lug aperture 129A overlaps the upper watch case aperture 217C and fits over the threaded cylinder 219C so as to overlap its corresponding lower watch case aperture 221C, and so that its second lug aperture 129B overlaps the upper watch case aperture 217C and fits over the threaded cylinder 219D so as to overlap its corresponding lower watch case aperture 221D.

With the case construction shown in FIG. 2, the upper watch case portion 205A is secured to the lower watch case portion 205B by fasteners that extend through each upper outer watch case aperture 217, each lug aperture 129, and through each lower outer watch case aperture 221. For example, with the embodiment illustrated in FIG. 2, the watch 201 includes four threaded screws 229A-229D. The first threaded screw 229A extends through the upper watch case aperture 217A, through the lug aperture 129A of the first band lug 123A, and through the lower watch case aperture 221A into the threaded cylinder 219A. Similarly, the second threaded screw 229B extends through the upper watch case aperture 217B, through the lug aperture 129B of the first band lug 123A, and through the lower watch case aperture 221B into the threaded cylinder 219B. The third threaded screw 229C then extends through the upper watch case aperture 217C, through the lug aperture 129A of the second band lug 123B, and through the lower watch case aperture 221C into the threaded cylinder 219C, while the fourth threaded screw 229D then extends through the upper watch case aperture 217D, through the lug aperture 129B of the second band lug 123B, and through the lower watch case aperture 221D into the threaded cylinder 219A.

Again, because the attachment portion 127 of each band lug 123 is securely sandwiched between the upper outer watch case portion 205A and the lower outer watch case portion 205B, rather than by the expansive force of a spring in a conventional springbar, a watch band attached to the band lugs 123 will be more securely attached to the watch 201 than with a conventional springbar. Further, because the band lugs 123 are incorporated directly into the case construction, the band lugs 123 can be substantially thicker, and thus stronger, than a conventional springbar.

Band Lug Configurations

With various examples of the invention, the band lugs 123 may be formed of a single piece of material, such as a metal, a metal alloy, a hard plastic, a hard resin, or a hard rubber. For still other examples of the invention, however, it may be useful to be able to change the length of the band portion 125 to accommodate differently sized watches. Also, it may be desirable to be able to separate sections of the band portion 125 so that it can be inserted into a springbar passage of a watch band. Accordingly, FIGS. 3-5 illustrate some band lug configurations that may be employed according to various examples of the invention.

Figure 3:
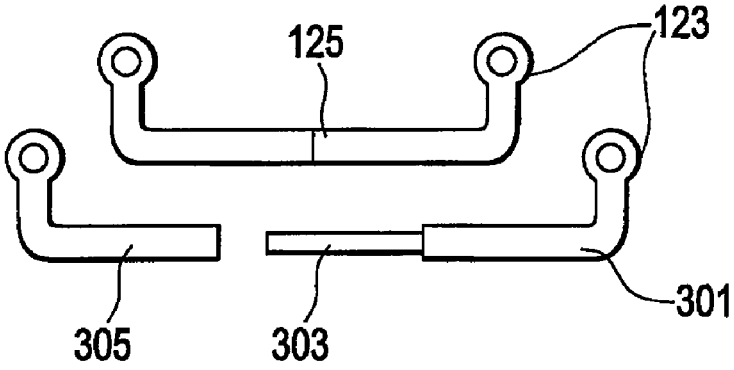
FIGS. 3-5 are planar views of watch band lugs that may be employed according to various examples of the invention.

For example, as shown in FIG. 3, the band portion 125 may be formed of a support portion 301 integrally formed with and supporting a male pin portion 303 and a separate female portion 305. As may be seen from this figure, the male pin portion 303 is inserted into a recess in the female portion 305, so that the male pin portion 303 can be slid along the length of the recess in the female portion 305 to change the length of the band portion 125. Further, with some implementations of the invention, the female portion 305 can be inserted into the springbar passage of a watch band, and the male pin portion 303 then inserted into the recess of the female portion so that the band portion 125 passes through the springbar passage.

Figure 4:
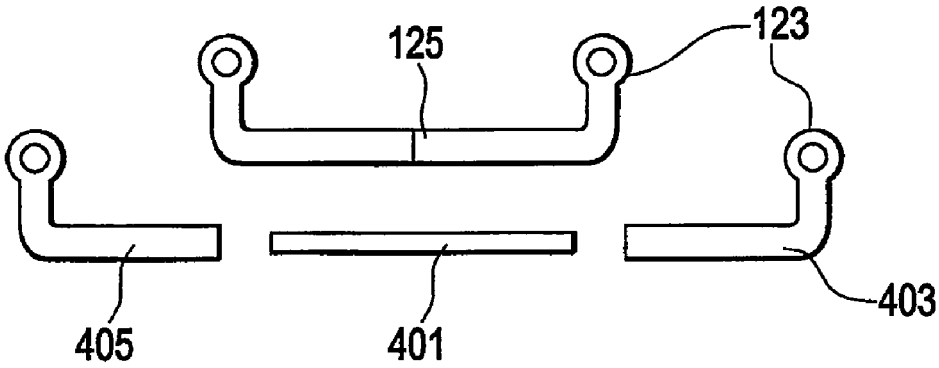

Alternately, as shown in FIG. 4, the band portion 125 may be formed of a separate male pin portion 401 and two female portions 403 and 405. As may be seen from this figure, one end of the male pin portion 401 is inserted into a recess in the female portion 403, while the other end of the male pin portion 401 is inserted into a recess in the female portion 405. In this manner, the male pin portion 401 can be slid along the length of the recess in either the female portion 403, the recess in the female portion 405, or both, to change the length of the band portion 125. Again, with some implementations of the invention, the male portion 401 can be inserted into the springbar passage of a watch band, and the female pin portions 403 and 405 then inserted over the male portion 401 so that the band portion 125 passes through the springbar passage FIG. 5 illustrates yet another implementation of a band lug 123. As seen in this figure, the band portion 125 may be formed of a separate female portion 501 and two separate male portions 503 and 505. As may be seen from this figure, the male pin portion 503 is inserted into a recess in one end of the female portion 501, while the male pin portion 505 is inserted into a second recess formed in the other end of the female portion 501. In this manner, the male pin portions 503 and 505 can be slid along the length of the aperture in either end of the female portion 501, or both, to change the length of the band portion 125. Further, with some implementations of the invention, the female portion 501 can be inserted into the springbar passage of a watch band, and the male pin portions 503 and 505 then inserted into the recesses of the female portion 501 so that the band portion 125 passes through the springbar passage.

Figure 5:
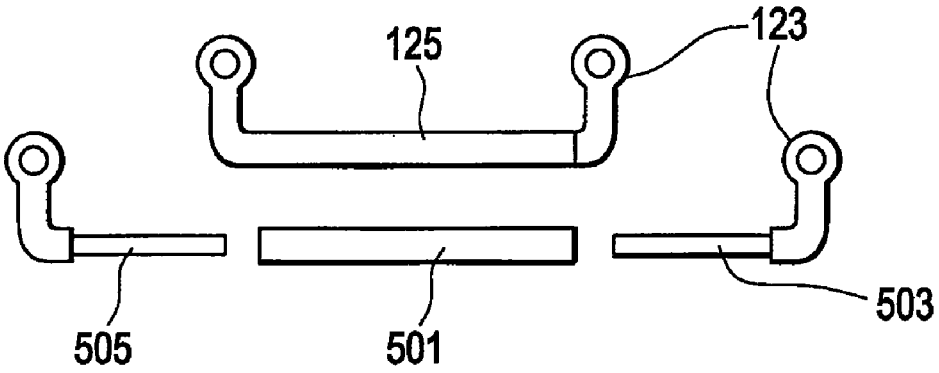

The implementation of the band lug 123 shown in FIG. 5 may additionally allow the female portion 501 to freely rotate around the male pin portions 503 and 505. This in turn may allow the watch band to more easily rotate relative to the two attachment portions 127 of the lug 123, and thus the watch. Further, the implementations of the band lug 123 shown in FIGS. 4 and 5, having portions formed with relatively simple shapes, may be more easily manufactured with some manufacturing techniques.

Alternate Implementations

While various implementations of embodiments of the invention have been described in detail above, it should be appreciated that there are a variety of alternate configurations that also may implement various embodiments of the invention. For example, some implementations of the invention may omit the threaded cylinders described above. Instead, a fastener, such as a bolt, may pass through an upper casing aperture, a lug aperture, and a lower casing aperture. The nut can then be screwed onto the end of the bolt to secure the upper casing to the lower casing, and thereby secure the band lug to the casing. Likewise, rivets or other such fastening devices can similarly be employed without using the threaded cylinders described above.

Also, while various examples described above employ a pair of band lugs, some implementations of the invention may employ only a single band lug. For example, a watch, such as a pocket watch or stopwatch, may have only a single band lug for attaching the watch to a watch band.

CONCLUSION

While the invention has been described with respect to specific examples including presently preferred modes of carrying out the invention, those skilled in the art will appreciate that there are numerous variations and permutations of the above described systems and techniques that fall within the spirit and scope of the invention as set forth in the appended claims.

What is claimed is:

1. An instrument module, comprising:

an instrument casing having:

an upper casing portion, the upper casing portion defining a first upper casing aperture;

a lower casing portion, the lower casing portion defining a first lower casing recess, the lower casing portion being engaged with the upper casing portion such that the upper casing portion and the lower casing portion form the instrument casing, and the first upper casing aperture is aligned with the first lower casing recess;

a first band lug having:

a band portion spaced apart from the instrument casing, the band portion for affixing a band thereto; and an attachment portion first arm, the first arm having a first end connected to the band portion and a second end extending outward from the band portion, the second end defining a first lug aperture, a portion of the attachment portion first arm being interposed between the upper casing portion and the lower casing portion so that the first lug aperture is aligned with the first upper casing aperture and the first lower casing recess; and a fastener extending through the first upper casing aperture, the first lug aperture, and the first lower casing recess to secure the first band lug to the instrument casing.

2. The instrument module recited in claim 1, wherein:

the upper casing portion further defines a second upper casing aperture, the first upper casing aperture and the second upper casing aperture being located on a first side of the upper casing portion, and a third upper casing aperture and a fourth upper casing aperture located on a second side of the upper casing portion opposite the first side of the upper casing portion; and the lower casing portion further defines a second lower casing recess, the first lower casing recess and the second lower casing recess being located on a first side of the lower casing portion, and a third lower casing recess and a fourth lower casing recess located on a second side of the lower casing portion opposite the first side of the lower casing portion, the upper casing portion being engaged with the lower casing portion such that the second upper casing aperture is aligned with the second lower casing recess, the third upper casing aperture is aligned with the third lower casing recess, and the fourth upper casing aperture is aligned with the fourth lower casing recess;

wherein the first band lug further includes an attachment portion second arm having a first end connected to the band portion and a second end defining a second lug aperture, a portion of the attachment portion second arm being interposed between the upper casing portion and the lower casing portion so that the second lug aperture is aligned with the second upper casing aperture and the second lower casing recess; and wherein the instrument module further comprises:

(a) a second band lug having a second band portion spaced apart from the instrument casing, the second band lug for affixing a band thereto and a second attachment portion first arm and second arm, each of the attachment portion first arm and second arm having a first end connected to the band portion and a second end defining a third lug aperture and a fourth lug aperture, a portion of the second attachment portion first and second arms being interposed between the upper casing portion and the lower casing portion so that the third lug aperture is aligned with the third upper casing aperture and the third lower casing recess, and such that the fourth lug aperture is aligned with the fourth upper casing aperture and the fourth lower casing recess;

(b) a second fastener extending through the second upper casing aperture, the second lug aperture, and the second lower casing recess to secure the first band lug to the instrument casing;

(c) a third fastener extending through the third upper casing aperture, the third lug aperture, and the third lower casing recess to secure the second band lug to the instrument casing; and (d) a fourth fastener extending through the fourth upper casing aperture, the fourth lug aperture, and the fourth lower casing recess to secure the second band lug to the instrument casing.

3. The instrument module recited in claim 2, wherein the band portion extends between the first end of the attachment portion first arm and the first end of the attachment portion second arm.

4. The instrument module recited in claim 1, further comprising a watch movement at least partially located within the instrument casing.

5. The instrument module recited in claim 1, wherein the first band lug includes a male pin portion that at least partially fits within a female receiving portion.

6. The instrument module recited in claim 1, wherein the first band lug includes a central pin portion that engages two female end portions.

7. The instrument module recited in claim 1, wherein the first band lug includes a central female receiving portion that engages two male end portions.

8. The instrument module recited in claim 1, wherein the attachment portion first arm is formed of a rubber or a plastic material.

9. The instrument module recited in claim 1, wherein the first band lug is formed of metal.

10. The instrument module recited in claim 1, wherein the band portion of the first band lug has a multi-part construction.

11. A watch, comprising:

an instrument module that defines an instrument casing, wherein the instrument module includes:

an upper casing portion defining a first upper casing aperture, a lower casing portion defining a first lower casing recess, the lower casing portion being engaged with the upper casing portion such that the upper casing portion and the lower casing portion form the instrument casing, and the first upper casing aperture is aligned with the first lower casing recess;

a first band lug having a band portion for affixing a band thereto and an attachment portion first arm having a first end connected to the band portion and a second end defining a first lug aperture, a portion of the attachment portion first arm being interposed between the upper casing portion and the lower casing portion so that the first lug aperture is aligned with the first upper casing aperture and the first lower casing recess, the band portion being spaced apart from the instrument casing; and a fastener extending through the first upper casing aperture, the first lug aperture, and the first lower casing recess to secure the first band lug to the instrument casing;

a watch movement at least partially housed within the instrument casing; and a band member engaged with the first band lug.

12. The watch recited in claim 11, wherein:

the upper casing portion of the instrument module further defines a second upper casing aperture, the first upper casing aperture and the second upper casing aperture being located on a first side of the upper casing portion, and a third upper casing aperture and a fourth upper casing aperture located on a second side of the upper casing portion opposite the first side of the upper casing portion, and the lower casing portion of the instrument module further defines a second lower casing recess, the first lower casing recess and the second lower casing recess being located on a first side of the lower casing portion, and a third lower casing recess and a fourth lower casing recess located on a second side of the lower casing portion opposite the first side of the lower casing portion, the upper casing portion being engaged with the lower casing portion such that the second upper casing aperture is aligned with the second lower casing recess, the third upper casing aperture is aligned with the third lower casing recess, and the fourth upper casing aperture is aligned with the fourth lower casing recess;

wherein the first band lug further includes an attachment portion second arm having a first end connected to the band portion and a second end defining a second lug aperture, a portion of the attachment portion second arm being interposed between the upper casing portion and the lower casing portion so that the second lug aperture is aligned with the second upper casing aperture and the second lower casing recess; and wherein the instrument module further comprises:

(a) a second band lug having a second band portion spaced apart from the instrument casing, the second band portion for affixing a band thereto and a second attachment portion first arm and second arm, each of the attachment portion first arm and second arm having a first end connected to the band portion and a second end defining a third lug aperture and a fourth lug aperture, a portion of the second attachment portion first and second arms being interposed between the upper casing portion and the lower casing portion so that the third lug aperture is aligned with the third upper casing aperture and the third lower casing recess, and such that the fourth lug aperture is aligned with the fourth upper casing aperture and the fourth lower casing recess;

(b) a second fastener extending through the second upper casing aperture, the second lug aperture, and the second lower casing recess to secure the first band lug to the instrument casing;

(c) a third fastener extending through the third upper casing aperture, the third lug aperture, and the third lower casing recess to secure the second band lug to the instrument casing; and (d) a fourth fastener extending through the fourth upper casing aperture, the fourth lug aperture, and the fourth lower casing recess to secure the second band lug to the instrument casing.

13. The watch recited in claim 11, wherein the first band lug includes a male pin portion that at least partially fits within a female receiving portion.

14. The watch recited in claim 11, wherein the first band lug includes a central pin portion that engages two female end portions.

15. The watch recited in claim 11, wherein the first band lug includes a central female receiving portion that engages two male end portions.

16. The watch recited in claim 11, wherein the attachment portion first arm is formed of a rubber or a plastic material.

17. The watch recited in claim 11, wherein the first band lug is formed of metal.

18. The watch recited in claim 11, wherein the band portion of the first band lug has a multi-part construction.

* * * * *